US005216866A

United States Patent [19]

Ekedal

[11] Patent Number: 5,216,866

[45] Date of Patent: Jun. 8, 1993

[54] REBAR MATRIX SPACER

[75] Inventor: David R. Ekedal, 4007 Crescent Point Rd., Carlsbad, Calif. 92008

[73] Assignee: David R. Ekedal, Carlsbad, Calif.

[21] Appl. No.: 826,131

[22] Filed: Jan. 27, 1992

[51] Int. Cl.[5] ..... E04C 5/16

[52] U.S. Cl. ..... 52/677; 52/684; 52/688

[58] Field of Search ..... 52/677, 678, 684, 685–689

[56] References Cited

U.S. PATENT DOCUMENTS

| | | | |
|---|---|---|---|
| 1,602,649 | 10/1926 | Chappell | 52/684 |
| 4,803,825 | 2/1989 | Wheeler | 52/689 X |
| 4,866,903 | 9/1989 | Ferstay | 52/677 |

FOREIGN PATENT DOCUMENTS

| | | | |
|---|---|---|---|
| 2405209 | 8/1974 | Fed. Rep. of Germany | 52/678 |
| 2206619 | 1/1989 | United Kingdom | 52/677 |

*Primary Examiner*—Richard E. Chilcot, Jr.
*Assistant Examiner*—Lan M. Mai

[57] ABSTRACT

This invention is a rebar spacer device which is used to set the rebar without using a tape. The device has an L-shaped track with scribe marks at pre-determined intervals on the top. The track further has integral upper and lower rails which have elongated cut-out on the edge. A plurality of rebar holder slidingly engaged to the track wherein each holder has clamping section for securing the rebar in place; Each holder further has grooves on the top and bottom portions wherein the grooves are complimentary to the upper and lower rails and mate with these rails when the rebar holders are mounted on the track.

1 Claim, 2 Drawing Sheets

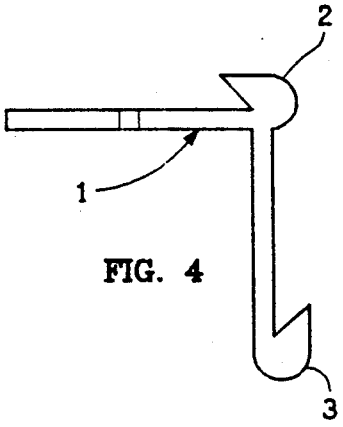
FIG. 4
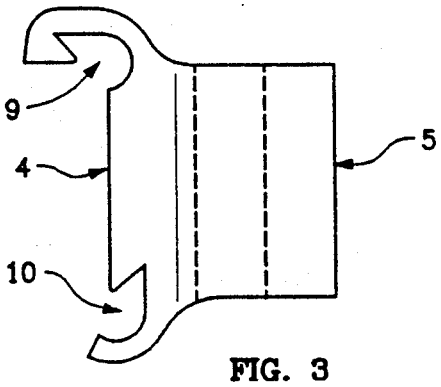
FIG. 3
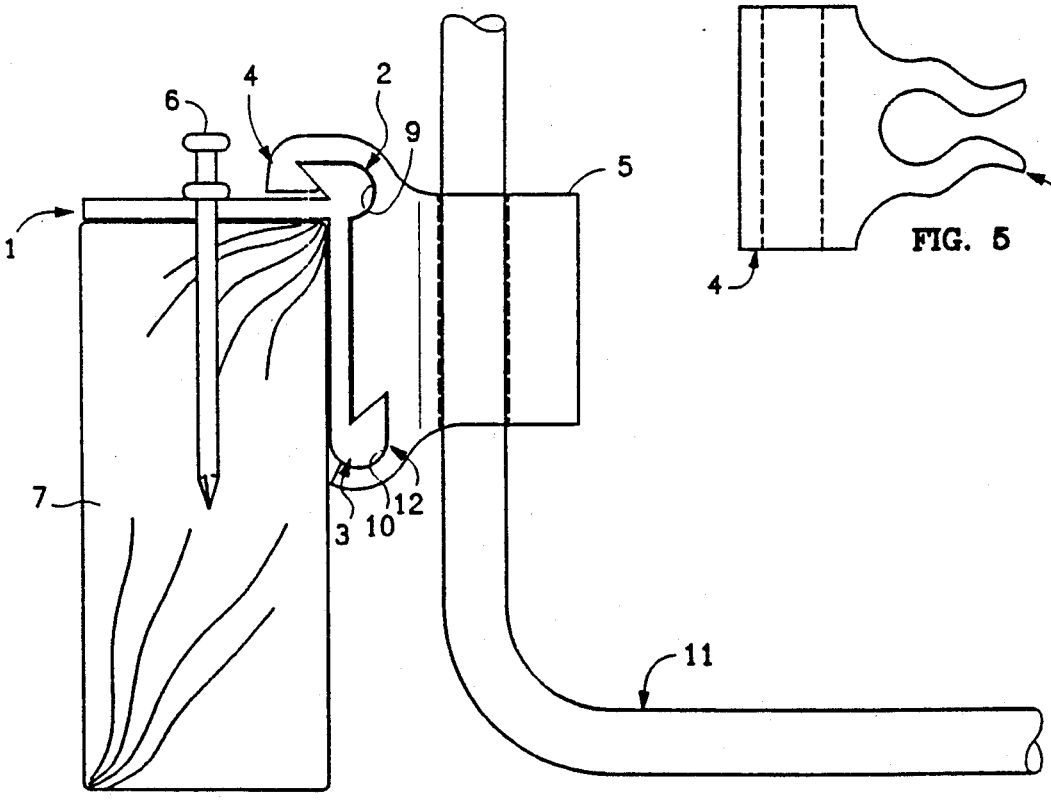
FIG. 2
FIG. 5

REBAR MATRIX SPACER

BACKGROUND

Monolithic concrete must contain reinforcing bars which are generally made of steel. Sometimes the reinforcing bar is of steel mesh which assures a regularly spaced pattern of bars which are appropriately supported so that when the concrete is poured the mesh will be enveloped in concrete. On other occasions, individual dowels of reinforcing bar, called REBAR, must be laid out. The current technique requires that each bar be individually placed and spaced at some interval, generally required by code, and the interval between each of the bars are individually checked. In addition, spacers, which may be crossties of other steel supported by stakes or rocks must also be inserted, measured and secured to assure that the reinforcing bar remains at the same horizontal level inside the concrete. The invention, herein described, is a flexible holder for the reinforcing bar.

DESCRIPTION OF THE DRAWINGS

FIG. 2—a cross-section view showing details of track and sliding holder.

FIG. 3—a cross-section of sliding holder showing detail.

FIG. 4—a cross-section view of track showing detail.

FIG. 5—a perspective of the sliding holder.

THE EMBODIMENT

Figure 1:
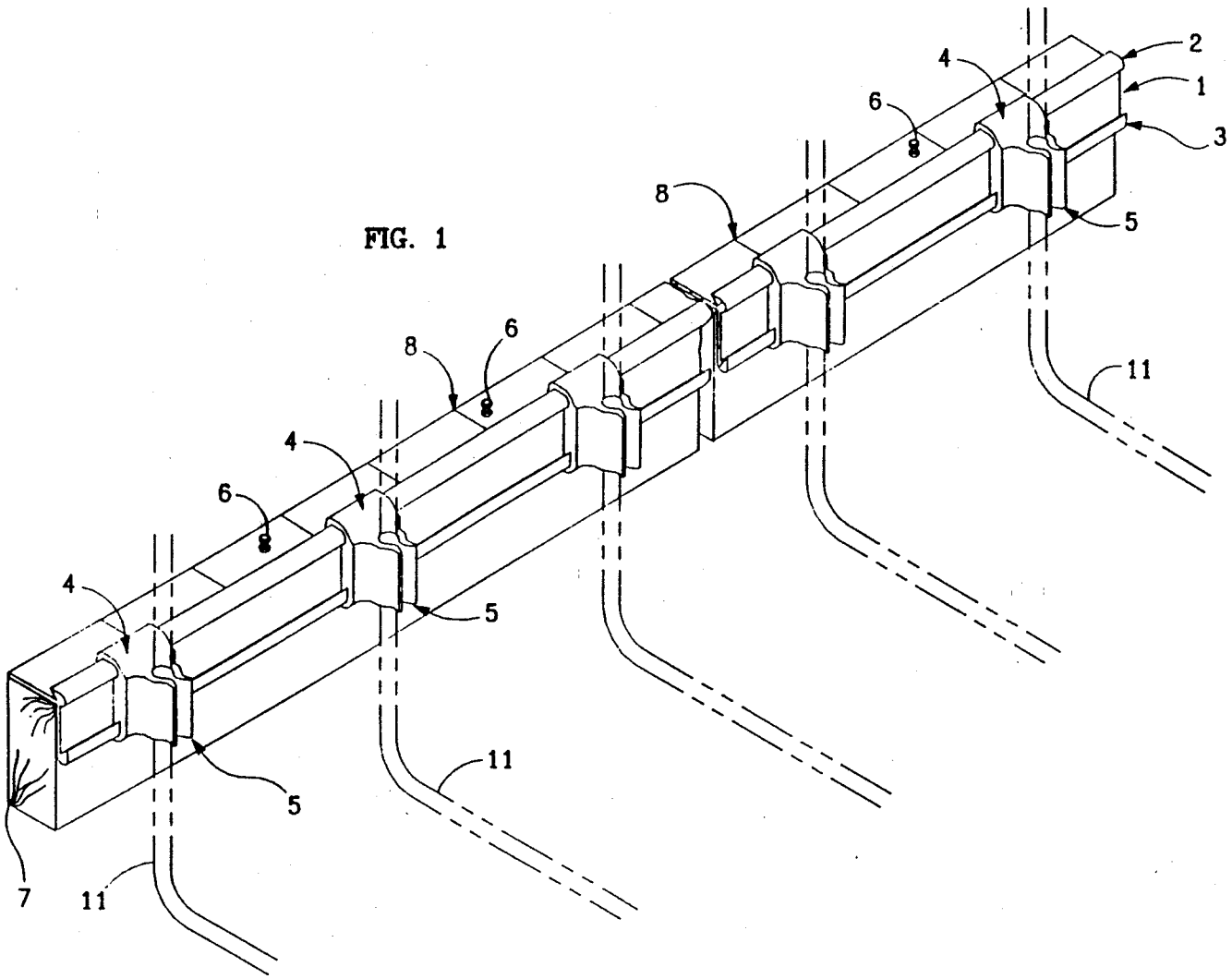
FIG. 1—a perspective showing typical components.

As shown in FIG. 1, the objective is to space out a matrix of reinforcing bar which is usually on four (4) inch intervals. The invention comprises two important components. One component is a track ,1, and the second component is a sliding holder, 4. The track is attached by nails, 6, to the framing, 7, timbers which are usually two-by-fours or deeper, depending on the thickness of the pour. The tracks have a regular pattern of holes so as to permit such track to be nailed to these framing timbers. In addition, inscribed along the visible section of the track is a metric, 8, which permits the sliding holders, 4, to be positioned at some regular interval. Each sliding holder has a grasp, 5, which will retain the concrete rebar.

FIG. 1 shows a perspective of the REBAR MATRIX SPACER system in place prior to a pour. The track, 1, is attached by nails, 6, to the framing, 7. Please note that the track has scribe marks of a metric, 8, at regular intervals. Sliding holders, 4, are placed at regular intervals along the track. Each sliding holder is fed into the track and constrained to a horizontal sliding motion by the upper rail, 2, and the lower rail, 3, which is integral to said track, 1. Each sliding holder, 4, has contact points of upper and lower grooves and a grasp, 5. It is the purpose of the grasp to hold the extremity of the rebar, 11.

Shown in FIG. 2 is a cross-section containing a nail, 6, the track, 1, and the sliding holder, grasping a extremity of rebar, 11. It also shows the mating of the sliding holder to the track by the engagement of the upper rail, 2, the complementary upper groove, 9, and the lower rail, 3, with its complementary lower groove, 10 of the siding holder.

FIG. 3 shows the side view of the sliding holder with its upper groove, 9, and lower groove, 10, in detail. This sliding holder is designed to slide horizontally along the track, 1, shown in FIG. 4, by grasping the upper rail, 2, and lower rail, 3, as bearing surfaces.

FIG. 5 shows the perspective of the sliding holder, 4, and the grasp, 5, which holds the rebar.

Materials to be used in this rebar spacing system may be metals or plastics of a disposable variety. The choice is a matter of economics.

The track is nailed to the framing and a multiplicity of sliding holders are placed on the track. The rebars are sized, bent, and placed in the grasp of each sliding holder. The position of each sliding holder is adjusted to some appropriate spacing according to the metric scribed on the track. Concrete may then be poured into the framing and the system of tracks and slides hold the rebar fixed in the required matrix.

The Inventor claims:

1. A rebar matrix spacer system which is to be placed within a framing structure with rebar and comprises a track, said track being L shaped with a multiplicity of holes for attachment means of said track to said framing and a multiplicity of scribe marks to provide a metric to be able to dimension intervals along said track, an upper rail at the contiguous corner of said L shaped track and a lower rail at the lower extreme edge of said track, a inner V-shaped slot on the upper edge of each said upper and lower rail;

a sliding holder which mates with said track, a upper groove with a complimentary shape to engage the upper rail of said track, and a lower groove at the bottom extremity of said sliding holder to complimentary engage said lower rail, a grasp centered transversely and on the outer face to said upper and lower grooves, said grasp dimensioned to hold said rebar;

so that pairs of said sliding holders holding the ends of the rebar can be placed in a sliding engagement with said tracks which are attached to said framing and said sliding holders can be appropriately spaced with said rebar, which has been appropriately dimensioned and spaced, in that such matrix of rebar will be held fixed within the framing by said system of tracks and holders to await a pour of concrete.

* * * * *